US005970618A

United States Patent [19]

Kuo

[11] Patent Number: 5,970,618

[45] Date of Patent: Oct. 26, 1999

[54] CUTTER WHEEL TYPE CAN OPENER

[76] Inventor: Teng-Tang Kuo, 7 Kung Yuang Rd., Taipei Hsien, Taiwan

[21] Appl. No.: 09/181,864

[22] Filed: Oct. 29, 1998

[51] Int. Cl.[6] ..... B67B 7/46

[52] U.S. Cl. ..... 30/434; 30/416; 30/433

[58] Field of Search ..... 30/416–427, 433, 30/434

[56] References Cited

U.S. PATENT DOCUMENTS 2,085,219 6/1937 Hosmer ..... 30/416
2,932,086 4/1960 Ruhle ..... 30/434 X

FOREIGN PATENT DOCUMENTS 613146 11/1948 United Kingdom ..... 30/416

*Primary Examiner*—Douglas D. Watts
*Attorney, Agent, or Firm*—Bacon & Thomas

[57] ABSTRACT

A cutter wheel type can opener includes a first handlebar and a second handlebar pivoted together, a lever pivoted to the first handlebar, a gear mounted on the first handlebar at one end, a cutter wheel mounted on the second handlebar at one end and rotated by the gear, a ratchet wheel mounted on the lever, and a stop plate mounted on the lever and retained in engagement with the ratchet wheel by spring means to limit the direction of rotation of the ratchet wheel, wherein continuously turning the lever up and down relative to the handlebars causes the cutter wheel to be continuously rotated in one direction in opening the lid of a can.

6 Claims, 7 Drawing Sheets

CUTTER WHEEL TYPE CAN OPENER

BACKGROUND OF THE INVENTION (a) Field of the Invention

The present invention relates to a can opener, and more particularly to a cutter wheel type can opener.

(b) Description of the Prior Art

A conventional can opener, as shown in FIG. 1, comprises a handle 10 having a can piercer 101 at one end and a bottle cap opener 102 at an opposite end. When operating this structure of can opener to open the lid of a can 20, must effort shall be employed to the can piercer 101 through the handle 10. FIG. 2 shows a cutter wheel type can opener according to the prior art. This structure of cutter wheel type can opener comprises a two handlebars 301,302, a drive wheel (not shown) mounted on the first handlebar 301, a driven wheel 40 mounted on the second handlebar 302 and meshed with the drive wheel, a cutter wheel 50 fixedly connected to the wheel shaft of the driven wheel 40, and a rotary knob 60 mounted on the first handlebar 301 for operation by hand to turn the drive wheel. Because the rotary knob 60 has a limited size, turning the rotary knob 60 with the fingers causes the fingers to ache quickly.

SUMMARY OF THE INVENTION

The present invention has been accomplished to provide a cutter wheel type can opener which eliminates the aforesaid problems. According to the present invention, the cutter wheel type can opener comprises a first handlebar having a curved front end, a second handlebar pivoted to the first handlebar by pivot means, the second handlebar having a curved front end reversed to the curved front end of the first handlebar, a cutter wheel mounted on the curved front end of the second handlebar at one side, the cutter wheel having an annular groove around the periphery of a wheel shaft thereof, a gear mounted on the curved front end of the first handlebar at one side and engaged into the annular groove at the cutter wheel, a lever pivoted to the second handlebar, the lever having a curved front end, a ratchet wheel mounted on the curved front and of the lever and coupled to the gear for synchronous rotary motion, and a spring retained stop plate coupled to the lever, the stop plate having a toothed portion meshed with the ratchet wheel to limit rotary motion of the ratchet wheel in one direction. When the lever is continuously turned up and down relative to the handlebars, the cutter wheel is continuously turned in one direction to cut open the lid of a can.

DETAILED DESCRIPTION OF THE PREFERRED EMBODIMENT

Figure 1:
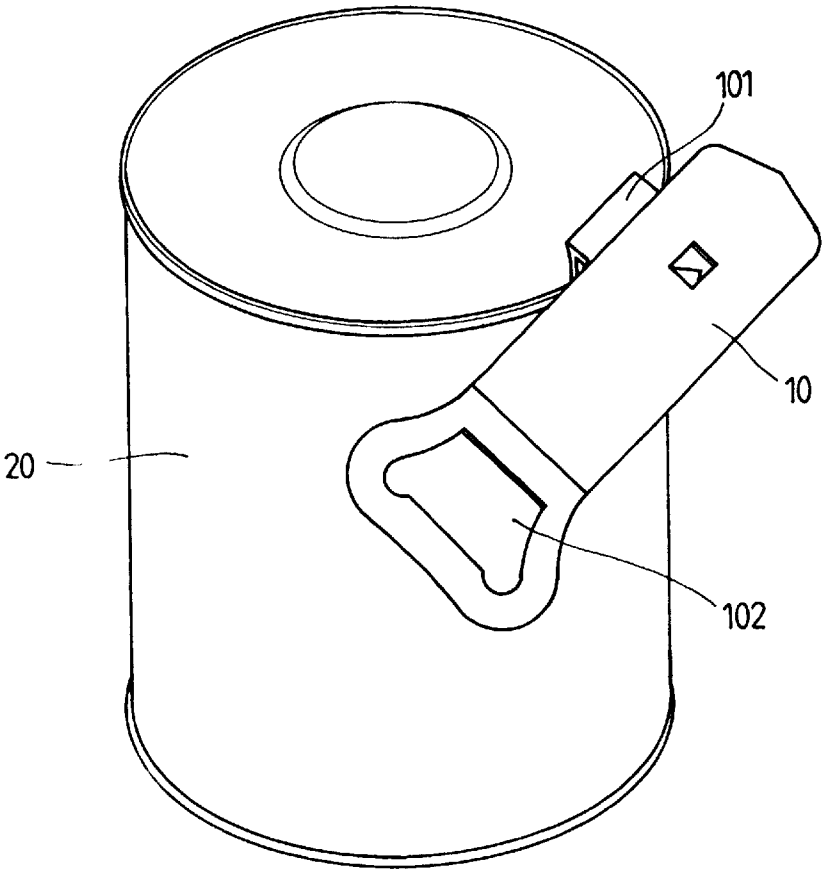
FIG. 1 (PRIOR ART)
FIG. 1 illustrates the use of a simple can opener according to the prior art.
Figure 2:
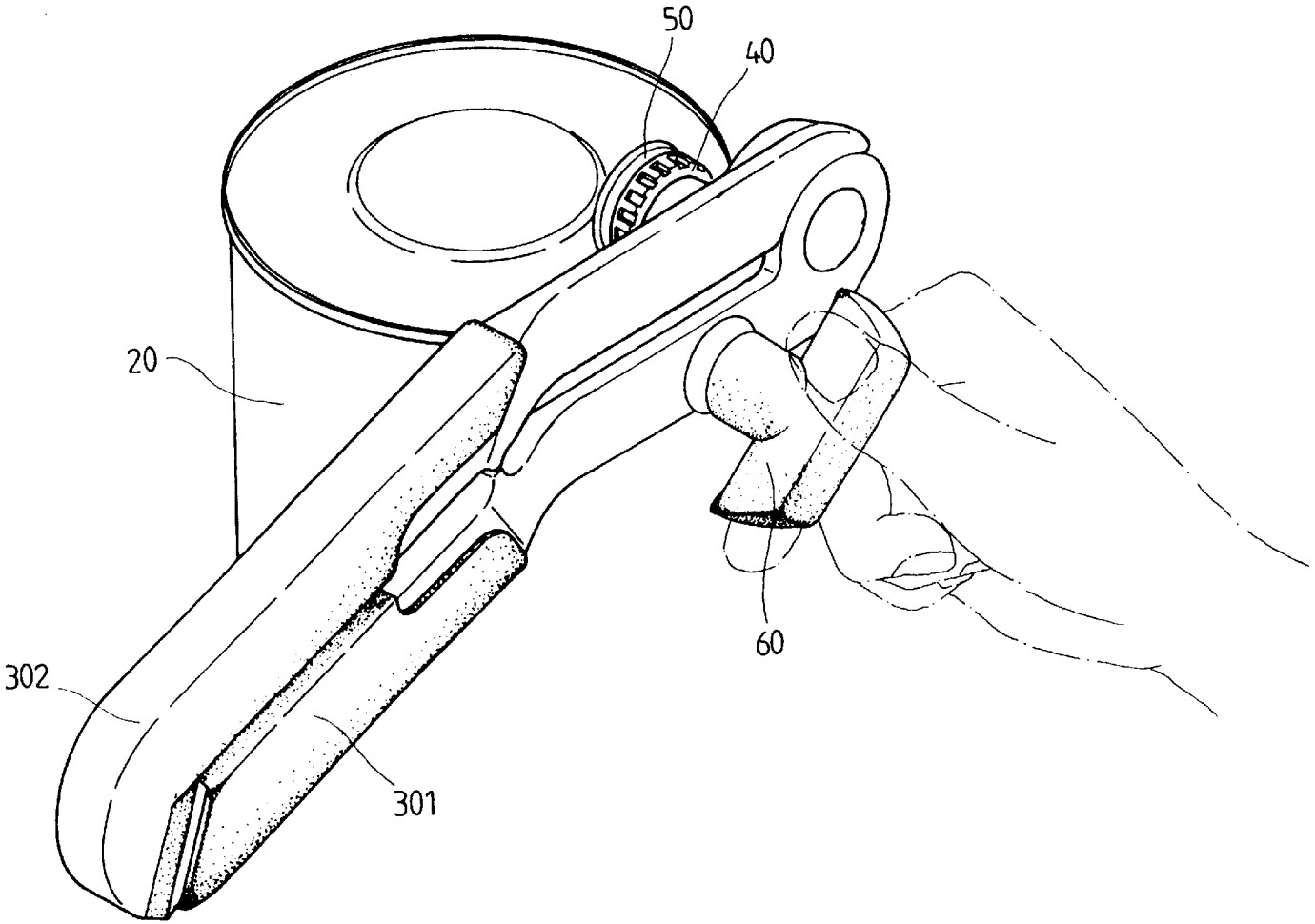
FIG. 2 (PRIOR ART)
FIG. 2 illustrates the use of a cutter wheel type can opener according to the prior art.
Figure 3:
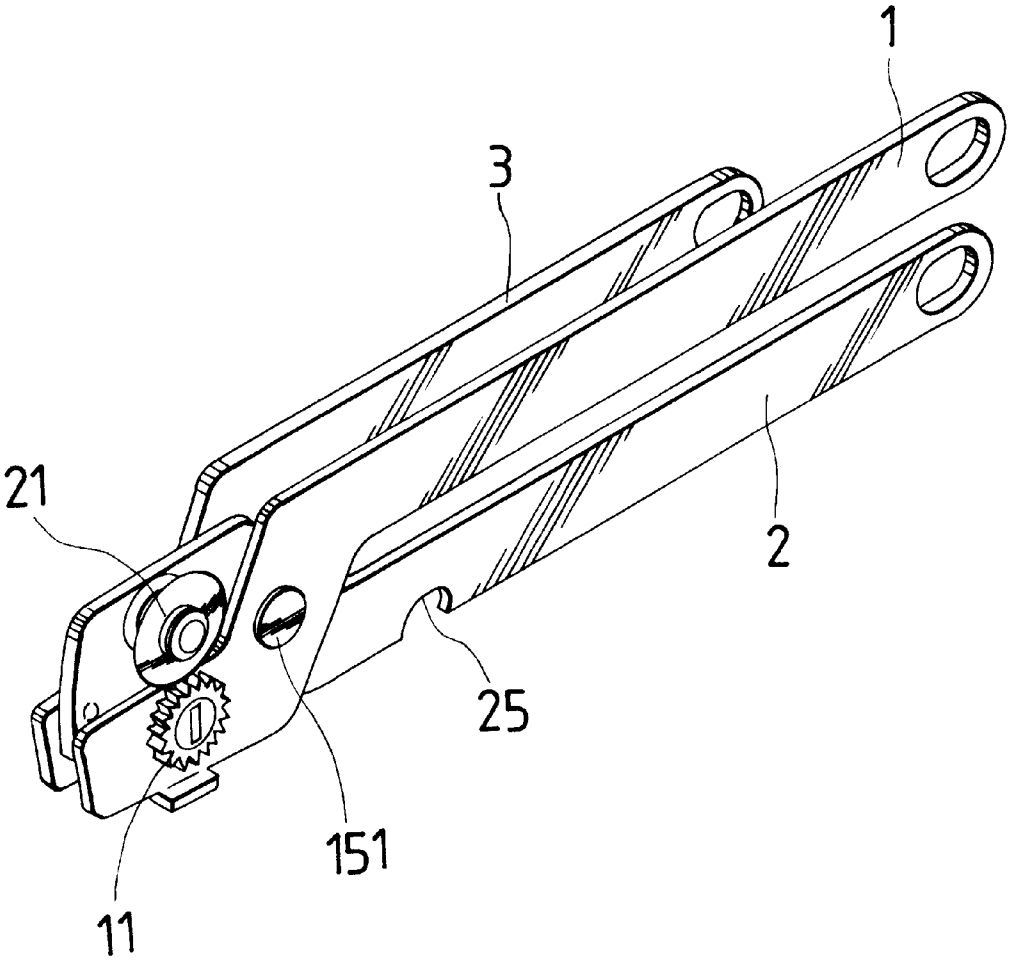
FIG. 3 is a perspective view of a cutter wheel type can opener according to the present invention.
Figure 4:
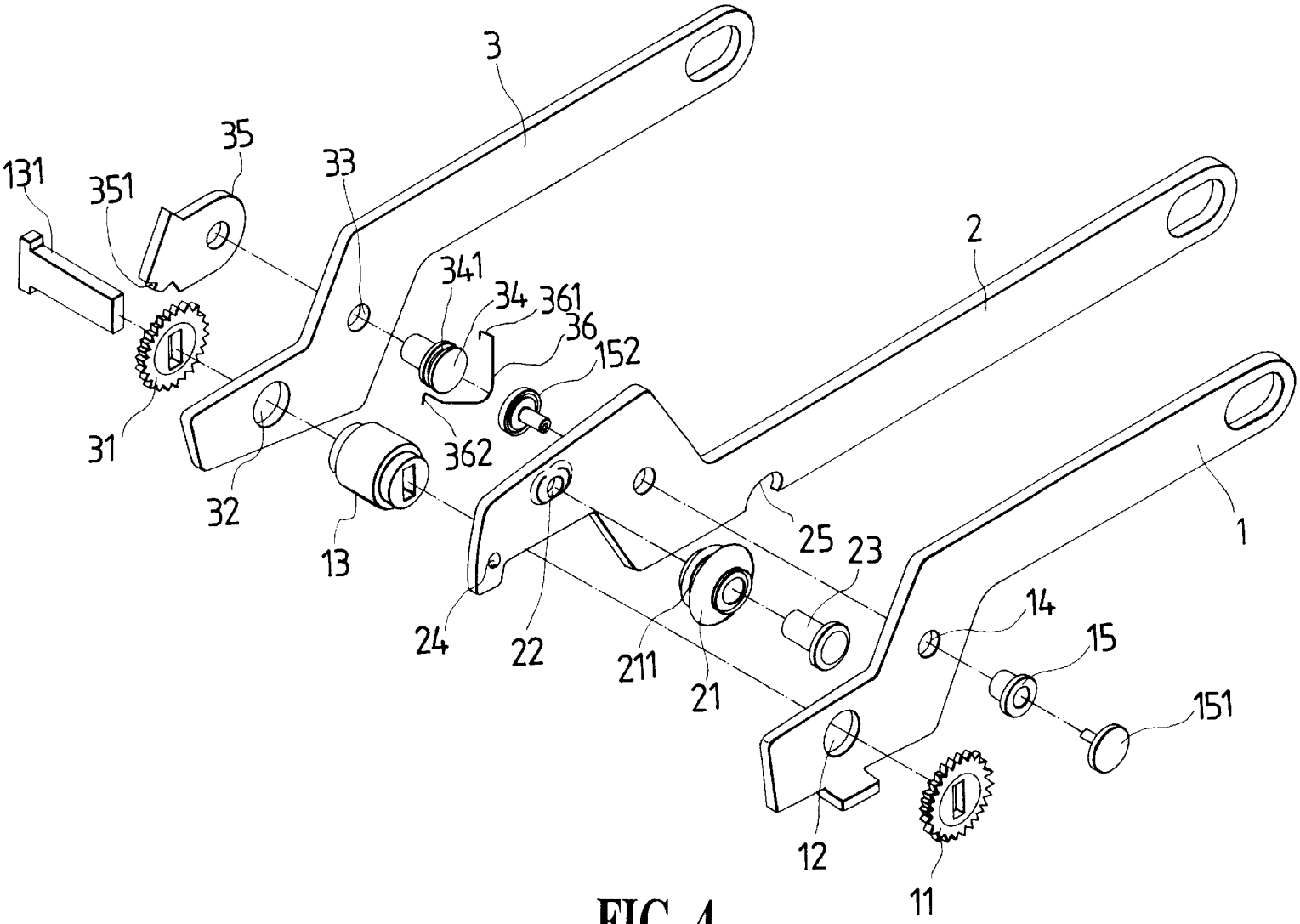
FIG. 4 is an exploded view of the cutter wheel type can opener shown in FIG. 3.

Referring to FIGS. 3 and 4, a cutter wheel type can opener in accordance with the present invention is generally comprised of a first handlebar 1, a second handlebar 2, a lever 3, a gear 11 coupled to the first handlebar 1 at one end, a cutter wheel 21 coupled to the second handlebar 2 at one end, and a ratchet wheel 31 coupled to the lever 3 at one end.

The first handlebar 1 comprises a mounting hole 12 at its curved front end in which one end of a connector 13 is installed to hold the gear 11, and a pivot hole 14 pivoted to the second handlebar 2 by a bushing 15, a male rivet element 151 and a female rivet element 152.

Figure 5:
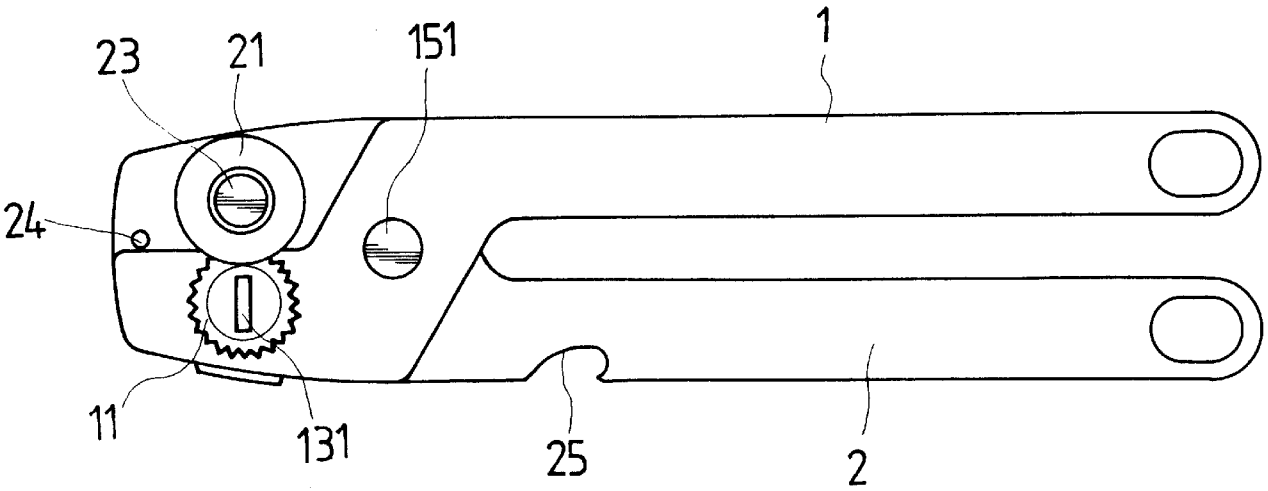
FIG. 5 is a front view of the cutter wheel type can opener shown in FIG. 3.
Figure 8:
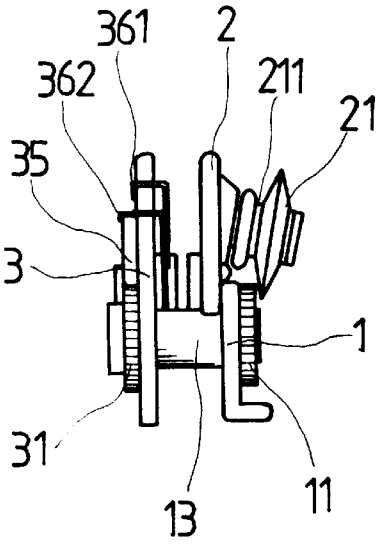
FIG. 8 is a front end view of the cutter wheel type can opener shown in FIG. 3.

The second handlebar 2 is pivoted to the first handlebar 1, and operated to make a scissors action with the first handlebar 1, having a mounting hole 22 near its front end, a raised stop portion 24, and a bottle cap opener 25 for opening the cap of a bottle. The cutter wheel 21 is fastened to the mounting hole 22 by a rivet 23, having an annular groove 211 around the periphery of its wheel shaft. When the first handlebar 1 and the second handlebar 2 are closed together, the gear 11 is engaged into the annular groove 211 of the cutter wheel 21 (see FIGS. 5 and 8), and the top end of the curved front end of the first handlebar 1 is stopped at the raised stop portion 24 of the second handlebar 2.

Figure 6:
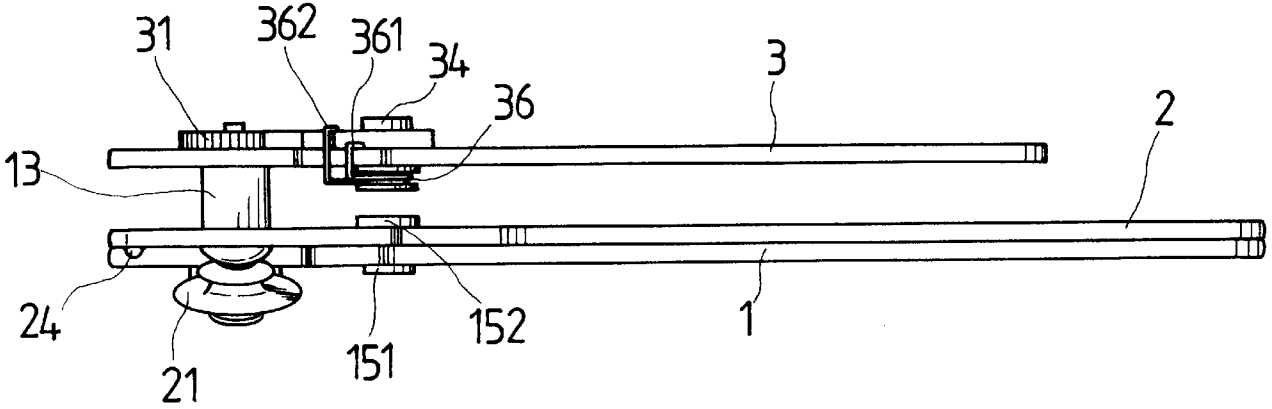
FIG. 6 is a top view of the cutter wheel type can opener shown in FIG. 3.
Figure 7:
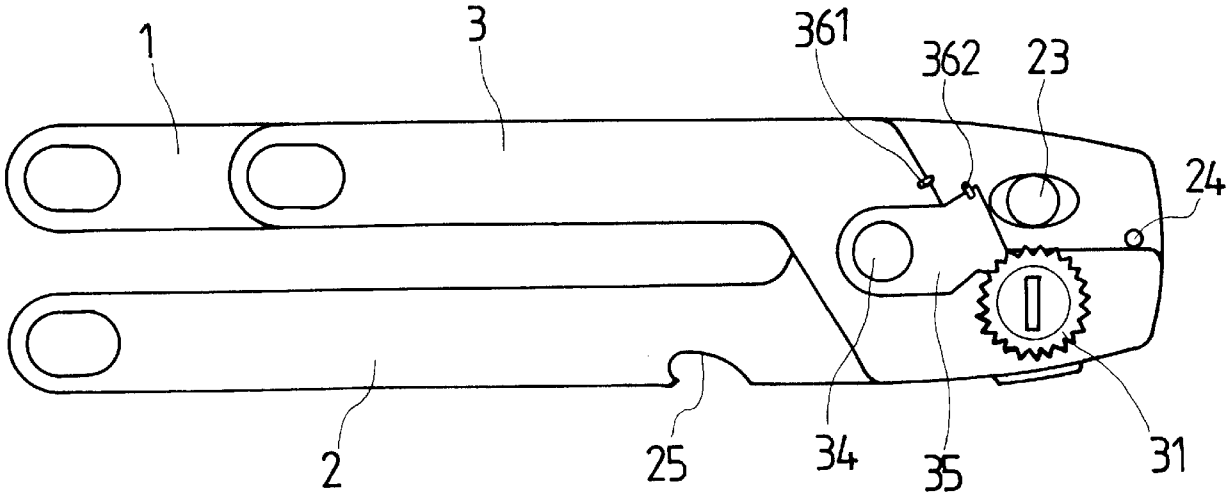
FIG. 7 is a rear side view of the cutter wheel type can opener shown in FIG. 3.

The lever 3 is coupled to the second handlebar 2 at one side opposite to the first handlebar 1, having a mounting hole 32 near its curved front end, which receives one end of the connector 13, and a through hole 33 adjacent to the mounting hole 32. The ratchet wheel 31 is mounted on one end of the connector 13, and disposed at one side of the lever 3 opposite to the second handlebar 2. A stop plate 35 is pivotably coupled to the through hole 33 by a bolt 34, having a toothed portion 351 meshed with the ratchet wheel 31. The bolt 34 has an annular groove 341 around the periphery of the head thereof. A spring wire 36 is mounted on the annular groove 341 at the head of the bolt 34, having a first hooked end 361 hooked on the lever 3 and a second hooked end 362 hooked on the stop plate 35 (see FIGS. 6 and 7). When the stop plate 35 limits the rotation of the ratchet wheel 31 in one direction only. Further, a flat connecting rivet element 131 is installed to connect the ratchet wheel 31, the connector 13 and the gear 11 together, enabling the ratchet wheel 31, the connector 13 and the gear 11 to be synchronously rotated.

Figure 9:
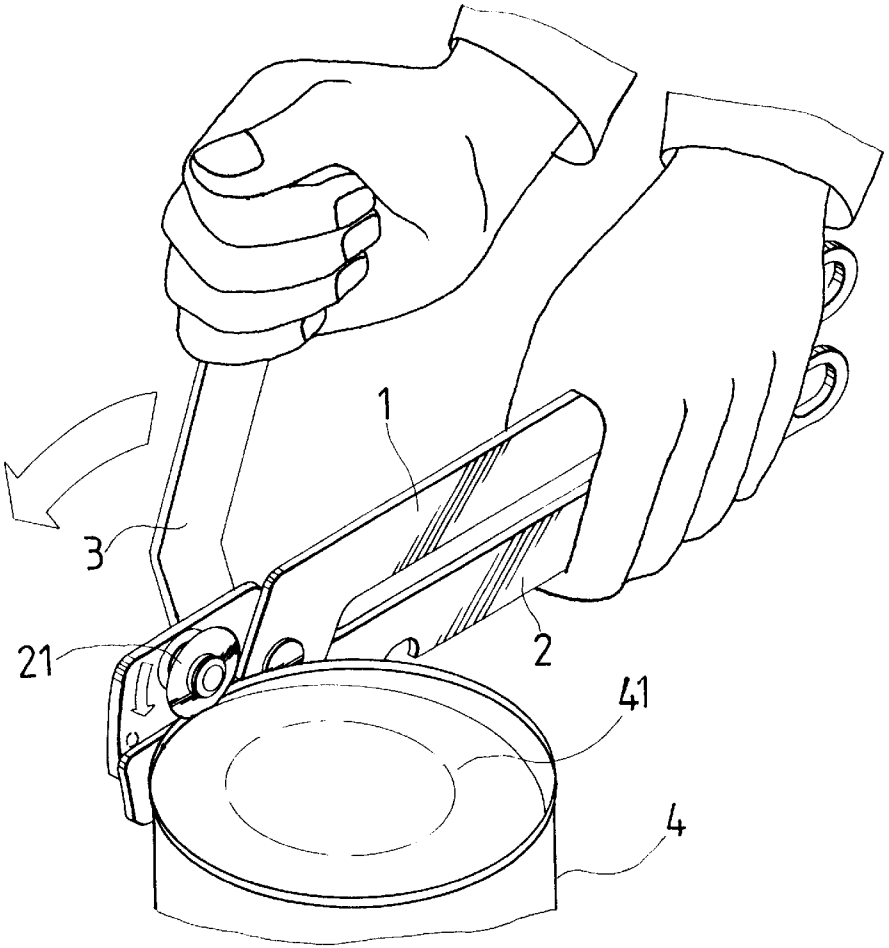
FIG. 9 is an applied view of the present invention, showing the cutter wheel type can opener operated, the lid of the can opened.

When in use, as shown in FIG. 9, the cutter wheel 21 and the gear 11 are attached to the rim of the lid 41 of the can 4, then the lever 3 is alternatively turned up and down relative to the handles 1,2, causing the cutter wheel 21 to be rotated and moved along the rim of the lid 41 of the can 4, and therefore the lid 41 of the can 4 is cut open.

What the invention claimed is:

1. A cutter wheel type can opener comprising:

a first handlebar having a curved front end;

a second handlebar pivoted to said first handlebar by pivot means, said second handlebar having a curved front end reversed to the curved front end of said first handlebar;

a cutter wheel mounted on the curved front end of said second handlebar at one side, said cutter wheel having an annular groove around the periphery of a wheel shaft thereof;

a gear mounted on the curved front end of said first handlebar at one side and engaged into the annular groove at said cutter wheel;

a lever pivoted to said first handlebar, said lever having a curved front end;

a ratchet wheel mounted on the curved front and of said lever and coupled to said gear for synchronous rotary motion; and a stop plate coupled to said lever, said stop plate having a toothed portion meshed with said ratchet wheel to limit rotary motion of said ratchet wheel in one direction.

2. The cutter wheel type can opener of claim 1 wherein the curved front end of said second handlebar has a raised portion at one side, which stops the curved front end of said first handlebar in position when said first handlebar and said second handlebar are closed.

3. The cutter wheel type can opener of claim 1 further comprising a bottle cap opener integral with one of said first handlebar and said second handlebar.

4. The cutter wheel type can opener of claim 1 further comprising a connector coupled between said first handlebar and said lever to hold said gear and said ratchet wheel together.

5. The cutter wheel type can opener of claim 1 wherein said lever comprises a through hole at its curved front end, a bolt mounted in said through hole to hold said stop plate, said bolt having a head and an annular groove around the periphery of the head, and a spring wire mounted on the annular groove at the head of said bolt and having two hooked ends respectively hooked on said lever and said stop plate to hold said stop plate in engagement with said ratchet wheel.

6. The cutter wheel type can opener of claim 4 wherein said ratchet wheel, said connector and said gear are connected together by a flat connecting rivet element for a synchronous rotary motion.

* * * * *